United States Patent [19]

Kekas et al.

[11] 4,402,620

[45] Sep. 6, 1983

[54] COMPACT SHUTTLE PRINTER MECHANISM

[75] Inventors: Dennis H. Kekas; Charles M. McCray, both of Raleigh, N.C.; William A. Grubbs, Rockville, Md.

[73] Assignee: International Business Machines Corp., Armonk, N.Y.

[21] Appl. No.: 333,599

[22] Filed: Dec. 23, 1981

[51] Int. Cl.[3] ..... B41J 3/12; B41J 25/28

[52] U.S. Cl. ..... 400/121; 400/320; 400/322; 400/611; 101/93.04

[58] Field of Search ..... 400/121, 124, 320, 322, 400/352, 328, 611, 617, 636; 101/93.04, 93.05

[56] References Cited

U.S. PATENT DOCUMENTS

| | | | |
|---|---|---|---|
| 4,127,334 | 11/1978 | Watanabe et al. | 400/320 X |
| 4,180,766 | 12/1979 | Matula | 310/27 X |
| 4,306,497 | 12/1981 | Hamada | 400/124 X |

*Primary Examiner*—Paul T. Sewell

*Attorney, Agent, or Firm*—Edward H. Duffield

[57] ABSTRACT

A compact shuttling printer mechanism suitable for use with dot forming print elements is disclosed. A single part plastic molding forms the frame and shuttling suspension for the print head or heads. The design utilizes a compound cantilevered spring principle. A linear reciprocable drive element acting as close as possible through the center of percussion of the print head and suspension assembly reciprocates the print head back and forth along a desired print line adjacent to a platen. Means for incrementing paper at the end of each reciprocation or stroke are provided. The design is adapted to provide print line visibility so that printed characters may be seen as they are formed. The reciprocation drive operates without orthogonal forces. It provides a purely linear drive force so that the machine is free of unwanted vibrations in other planes or axes. The unitary molded plastic compound cantilever spring and frame assembly greatly reduces the size, cost and complexity of the printing mechanism. A unique advantage of the cantilevered spring suspension system is the air motion provided from the flexing of the cantilever spring elements. The air motion may be used for cooling electronics and logic housed in conjunction with the printer operation function.

4 Claims, 9 Drawing Figures

COMPACT SHUTTLE PRINTER MECHANISM

RELATED APPLICATIONS

This application is related to copending application Ser. No. 333,598, filed simultaneously herewith and commonly assigned herewith.

FIELD OF THE INVENTION

This invention relates to dot matrix printers in general and to print head suspension or carrier systems for such printers in particular and to drive mechanisms for oscillating the print head carrier or suspension systems therein.

PRIOR ART

A wide variety of dot matrix print mechanisms are known, of course. Those employing a shuttle principle in which print heads are affixed to a movable carrier are commonplace, but those in which the print heads and the carrier move together as a single piece are relatively few. Only U.S. Pat. No. 4,127,334 is presently known to the applicant for this latter type of design.

This patent utilizes a generally E-shaped pair of flexible spring elements to support a rigid frame on which are mounted one or more print heads for reciprocation along a printing line. The E-shaped spring elements are known to provide a linear translation when the top and bottom legs of the E-shaped springs are anchored to framework and the center leg is flexed back and forth. Two sets of such E-shaped springs are employed in this known patent, with the print head framework being affixed to the center legs of the E-shaped springs. There is one set of springs at each end of a general printing region. This patent also includes an off-center crank reciprocating driving means operating as an ordinary connecting rod and crank mechanism. This mechanism introduces forces which are not in the desired line of travel and hence introduces unwanted vibrations in a direction perpendicular to the desired printing line. In addition, this patent employs compound springs built up from several pieces requiring mechanical affixation and interconnection with the other elements such as the print head mounting framework. Also, it requires additional frame elements for mounting the springs themselves. The complex assembly of multiple pieces is subject to requiring periodic adjustment, may involve additional manufacturing and maintenance expense, and may also produce a higher degree of unreliability due to the numerous parts and concommitant potential areas for mechanical failure.

OBJECTS OF THE INVENTION

In view of the foregoing difficulties with the known prior art, it is an object of this invention to provide an improved reciprocating, shuttling printer of reduced cost and complexity and utilizing only a single piece combination suspension, framework and cooling mechanism.

An additional object of the present invention is to provide an improved reciprocable drive which is electronically controllable to provide purely linear acceleration forces in direct axial alignment with the motion of the shuttle framework along the printing line.

Still a further object of this invention is to provide a compact, low cost printer of modular form that can be added in replication to a given terminal or printing application where one or more printing stations may be required for the same machine.

SUMMARY

The foregoing and still other objects not enumerated are met in the present invention by providing a one-piece plastic molded compound cantilever spring and shuttle framework assembly for supporting one or more print heads. In addition, a unique voice coil linear reciprocating apparatus may be directly connected to the shuttle framework to provide colinear pure acceleration forces free of unwanted vibrations in other planes and axes. It has also been unexpectedly discovered that the fanning action of the flexing cantilever compound springs can be used to provide a cooling effect for electronic elements mounted within the housing of the printer. A one-piece plastic molding having two generally E-shaped plate spring end panels is used. The flexible E-shaped plate spring elements have upper and lower legs of the E-shapes connected together by a printhead framework and support which is molded simultaneously and integrally with the E-shaped plate spring elements. This one-piece compound spring and framework is mounted to the frame of the printer housing by a rigid attachment with the center legs of the E-shaped spring panels in a manner contrary to that shown in prior art printers of this type. This provides a print line visibility since the print head framework joined by the two E-shaped spring elements can have the print heads located generally colinear with the top most legs of the E-shaped spring to bring the print line up near the top of the printing mechanism for easy visibility of the resulting print.

The invention will now be described with regard to a preferred embodiment showing the best mode contemplated for utilizing the invention as shown in the accompanying drawings as follows.

DETAILED SPECIFICATION

Figure 1:
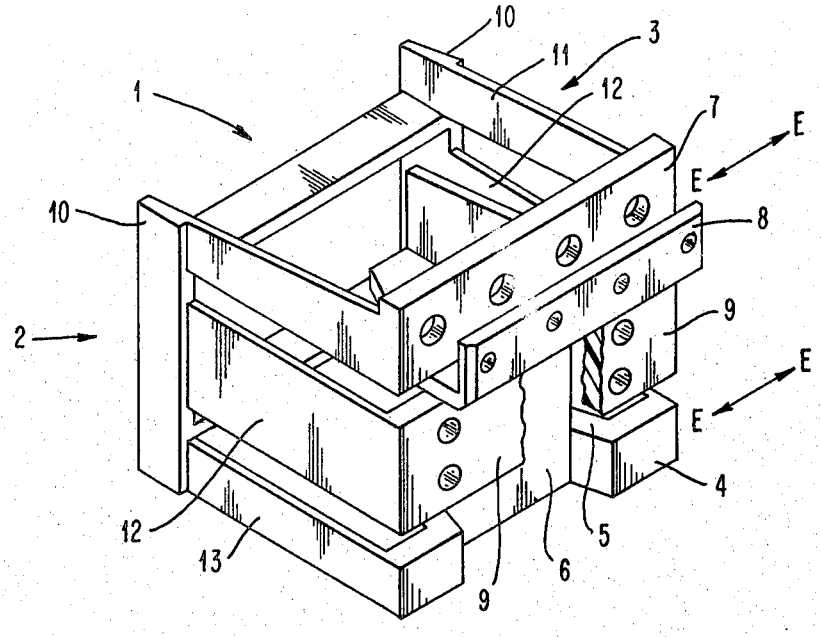
FIG. 1 illustrates a pictorial view of the one-piece molded plastic print head suspension, compound cantilever spring and head mounting frame element.

The print head suspension framework and mounting system which is depicted in FIG. 1 is an integrally molded single piece of plastic. The design was originated to obtain the lowest possible parts cost. The design requires, due to the flexing of the E-shaped cantilever spring members, a relatively low tensile modulus material in order to keep the spring rate as low as possible since the spring loads will be reflected as loads on the moving voice coil driver system. However, creep modulus of the selected material must be sufficiently high so as to minimize cold flow problems. A number of materials were surveyed and parts were modeled. The most effective material is a polysulfone having a creep modulus of 325 KPSI at 70° F. and a 4 KPSI load, a tensile modulus of $3.54\times10^5$ PSI and a specific gravity of 1.37. Other suitable materials are polyester and copolymers of engineering structural polymer. In general, the desired materials must have 1.1 to 1.4 specific gravity, $3.4\times10^5$ PSI minimum tensile modulus and a creep modulus of 320 KPSI minimum at 73° F. and 1.5 KPSI load.

Turning to FIG. 1, the one-piece molded print element shuttle suspension and frame member 1 is seen to comprise two relatively E-shaped cantilever spring elements at the ends 2 and 3, respectively.

The molded E-shaped spring members are made such that each member 2 and 3 has first, second and third legs numbered 11, 12 and 13, respectively. Legs 12 are made twice the width of legs 11 and 13 so that the combined spring rate of the outer leaves 11 and 13 exactly equals that of the center leaf 12. The outer ends forming the vertical bar of the E-shape on each of the spring suspension members 2 and 3 are formed together in a common piece 10. As will be seen later, when the suspension elements of the molded spring assembly are operated in flexure, the end pieces 10 can be utilized to provide a fanning and cooling action for electronic components necessary for the operation of the printer.

Print head carrier frame 7 and aligning member 8 are integrally molded with the spring suspension system. A connector bar 6 connecting the upper framework elements 7 and 8 to the lower framework elements 4 and 5 assures that elements 4, 5, 7 and 8 will move together in reciprocation. The oscillatory drive means applies reciprocating forces along the line EE in FIG. 1. This means will be described in greater detail below.

Elements 7 and 8 are shown with alignment holes for accepting wire matrix print heads. It is equally advantageous to employ ink jet dot printers, thermo electric printers, and the like. The holes shown in members 7 and 8 are therefore only indicative of the relative positions of a plurality of dot forming heads which may be carried by members 7 and 8.

The frame piece 9 is integrally molded with the E-spring elements and is affixed to the center legs 12 of each E-shaped spring end piece 2 and 3, respectively. Frame piece 9 is affixed to rigid framework in the printing machine mechanism not shown. Thus, the center legs 12 are rigidly anchored by the attachment frame members 9 to a mechanical ground.

The element 5 may have attached to it an optical timing emitter in the form of an apertured grid strip. This serves as a timing emitter of the well known sort normally employed in wire matrix or dot matrix printers to give appropriate timing pulses for use in an electronic control system for synchronizing the firing of the dot matrix solenoids or the like to construct the desired characters.

Figure 2:
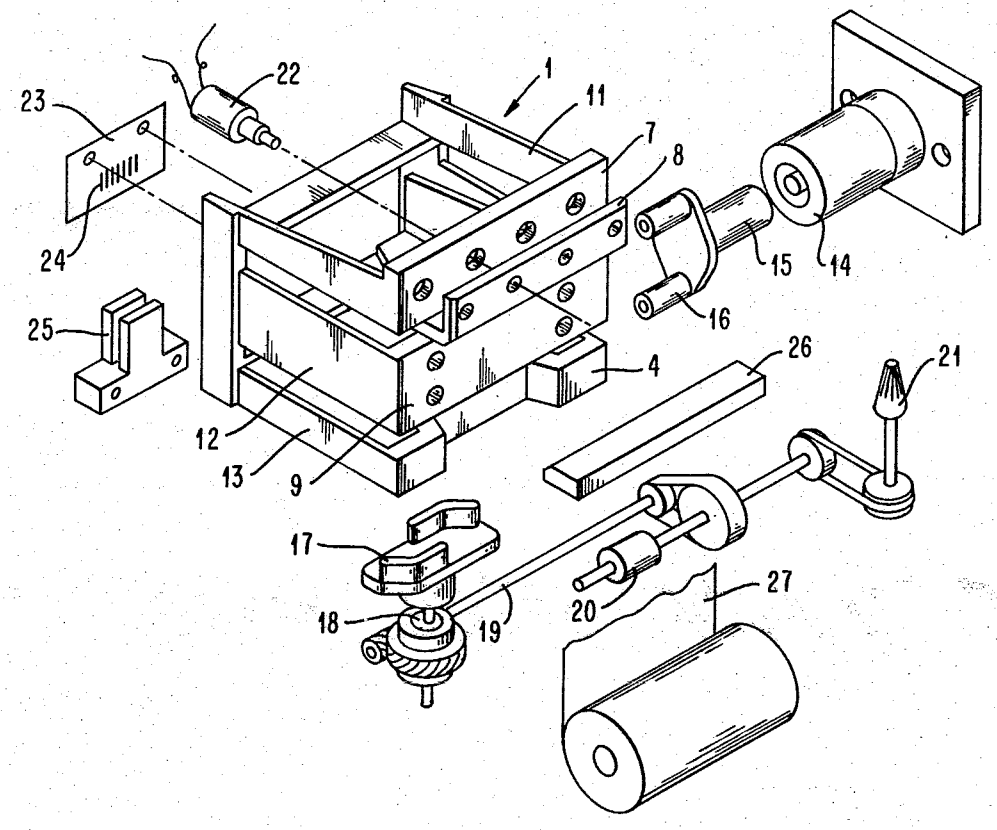
FIG. 2 illustrates an exploded schematic view of the major components for the printer utilizing the one-piece molded suspension and spring assembly of the present invention as well as the voice coil driver assembly of the present invention and other elements of the preferred embodiment.

Turning to FIG. 2, the overall major components of a preferred embodiment of a dot matrix printer mechanism utilizing the integrally molded spring framework suspension and carrier assembly 1 are shown. A preferred embodiment of the linear voice coil actuator 14 having a movable armature or coil 15 and a driving bulkhead 16 as utilized in the preferred embodiment is also shown together with other elements in the preferred design. A roller member not shown in FIG. 2 is affixed to the bottom of the frame member 5 or 4 to interact with the cam member 17 at each end of oscillatory stroke. This action rocks the cam member 17 in a clockwise or counter clockwise direction depending upon the direction of motion of member 4. A one-way clutch 18 torqued by cam 17 provides a unidirectional rotary motion output on shaft 19 for the purpose of incrementing a paper feed roller 20 and driving a ribbon drive spindle 21.

An individual print element 22 is shown positioned coaxially with a set of the apertures in the frame member 7 and 8, it being understood that one or more such print heads 22 may be employed and that they may be of any of a variety of types. An emitter aperture grid 23 containing numerous apertures or slots 24 may be affixed to member 4 or 5 (not visible in FIG. 2) for oscillation back and forth with the carrier and suspension. The emitter grid 23 may pass between the typical photo source and sensor mounting block 25. Block 25 contains a light emitting diode and a photo sensor on opposite sides of a slot through which the emitter grid 23 reciprocates in a well known fashion.

A fixed platen 26 is shown positioned adjacent the printing area where the print head 22 will be reciprocated. Paper feed rolls 20A and 20B can, through a normal friction feeding engagement with a paper supply 27, cause the paper to increment by one dot height. It is necessary to feed the paper supply at the end of each reciprocating stroke of the carrier to begin printing a new dot row. This is done by means of a cam member 17, one way clutch 18, etc.

Figure 3:
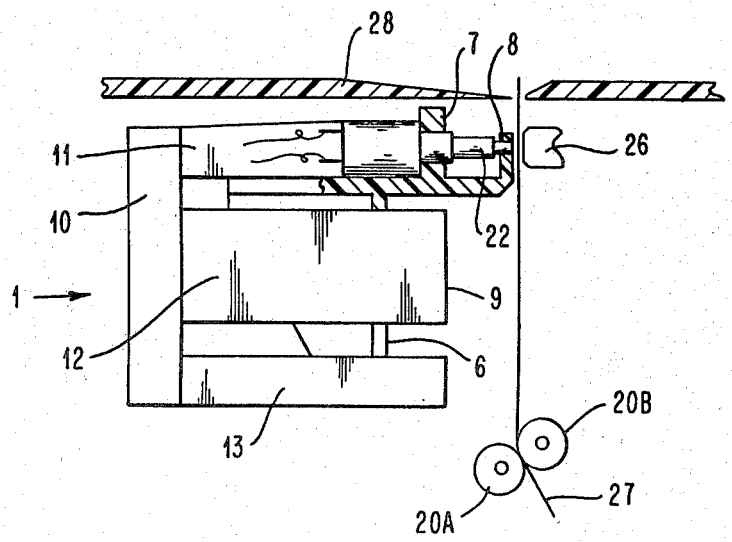
FIG. 3 illustrates a schematic cross-sectional view taken toward the edge of the paper in a printer constructed according to the general scheme shown in FIG. 2.

Turning to FIG. 3, a schematic cross section of the major elements depicted for the assembly in FIG. 2 is illustrated. As may be seen, the feed rolls are depicted as roll pair 20A and 20B which frictionally grip and drive the paper 27. The cantilever suspension assembly 1 is rigidly affixed by the frame piece 9 attached to the center leg 12 of each of the E-shaped spring members. The molded framework 7 and 8 are shown together in a mere schematic representation. The print heads 22 would be coplanarly arranged with respect to the printing surface on platen 26 as indicated. They may form a colinear or vertically staggered array if desired. An overall cover which may incorporate a plastic tearing knife or guide bar 28 is also shown.

Figure 4:
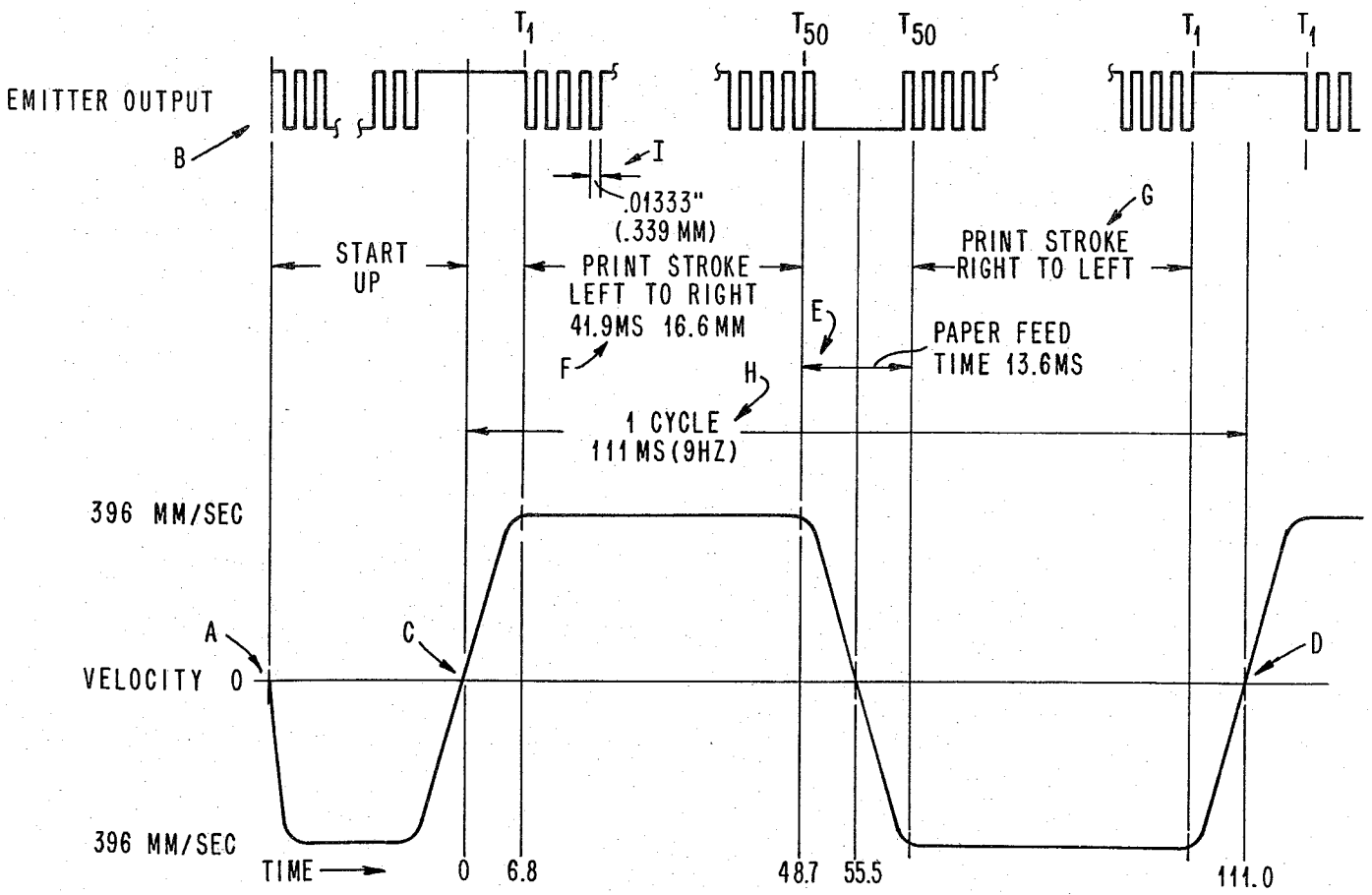
FIG. 4 illustrates the emitter output, velocity of the print head and direction of travel for several half cycles of operation.

Turning to FIG. 4, a timing diagram for a preferred embodiment of the printer as schematically illustrated in FIGS. 2 and 3 is shown.

In FIG. 4 line A illustrates a velocity versus chart time. An initial "set-up" time between point A and point C during which the one-piece molded carrier and print head assembly is accelerated from 0 to 396 millimeters per second velocity is shown. This time period may be arbitrary, but typically requires approximately 20 milliseconds. From point C to point D on line A, one full cycle of printing consisting of a left to right and a right to left printing stroke is indicated. The elapsed time of 110 milliseconds is arbitrary and of course longer print lines or greater or lower speeds might be employed. The desired printing stroke covers approximately 16.6 millimeters which is sufficient to encompass 10 dot matrix characters of 5 dots of primary width each.

As shown by section E in FIG. 4, a brief period at the end of each printing stroke left to right or right to left is allowed for paper feeding time (approximately 13.6 milliseconds) as shown. The left to right and right to left print strokes are indicated in sections F and G, respectively, and are truncated to show only a few of the 50 emitter pulses on line B which would be desired. Between the times labeled $T_1$ and $T_{50}$, these emitter pulses would be produced by the aperture emitter 23 shown in FIG. 2. Each emitter pulse has a total duration which corresponds to a distance of approximately 0.339 millimeters of lateral travel. Wire firing for wire matrix print heads can be easily timed as well-known in the art to the rising or falling edge of such pulses produced by an emitter.

Figure 5:
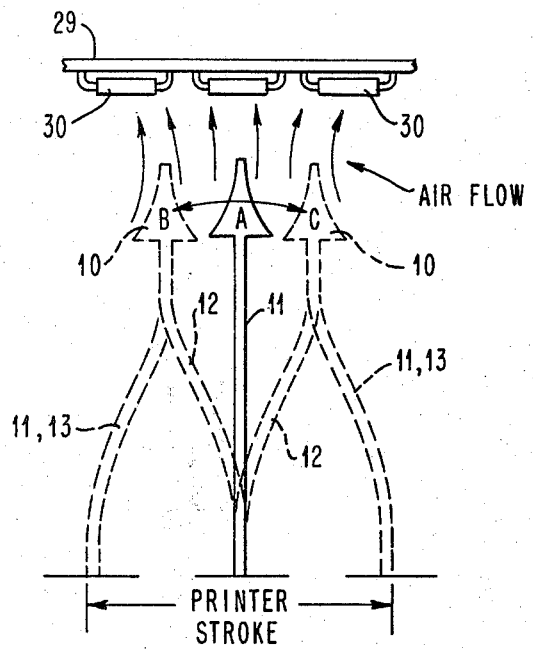
FIG. 5 illustrates the air moving function of the vanes of the rear of the E-spring assemblies which are integrally molded with the device shown in FIG. 1.

Turning to FIG. 5, a plan view of a portion of the integrally molded spring and suspension means 1 is shown. Only the leaves of the E-shaped spring members 11, 12 and 13 and the connecting end pieces 10 are indicated. The rest position is identified as position A in which only the top most leaf 11 of the E-shaped member is visible. On a printing stroke to the right (to position B for element 10) the center leaf 12 becomes exposed as leaves 11 and 13 flex to the left (equivalent to the print head carrier 7, 8 moving toward the right in FIGS. 1 and 2). In the opposite direction of travel from the rest position A, printing is also accomplished. The left is indicated by the position of element 10 indicated by a letter C. This back and forth motion of the leaves 11, 13 and the common connector members 10 produces a significant air flow shown generally by the arrows in FIG. 5. This air flow may be directed or channeled to impinge upon a circuitboard 29 carrying electronic component 30 schematically shown as resistances. As is well known in the printer field, electronic circuitboards 29 typically require small cooling fans or other sources of air flow to provide adequate cooling for stable operation of sensitive electronic components. By adding a fan shaped flap 10 as the common connector illustrated in FIGS. 1 and 2, etc., the integrally molded spring and suspension carrier assembly also serves as a fan to provide this cooling flow of air.

Figure 6:
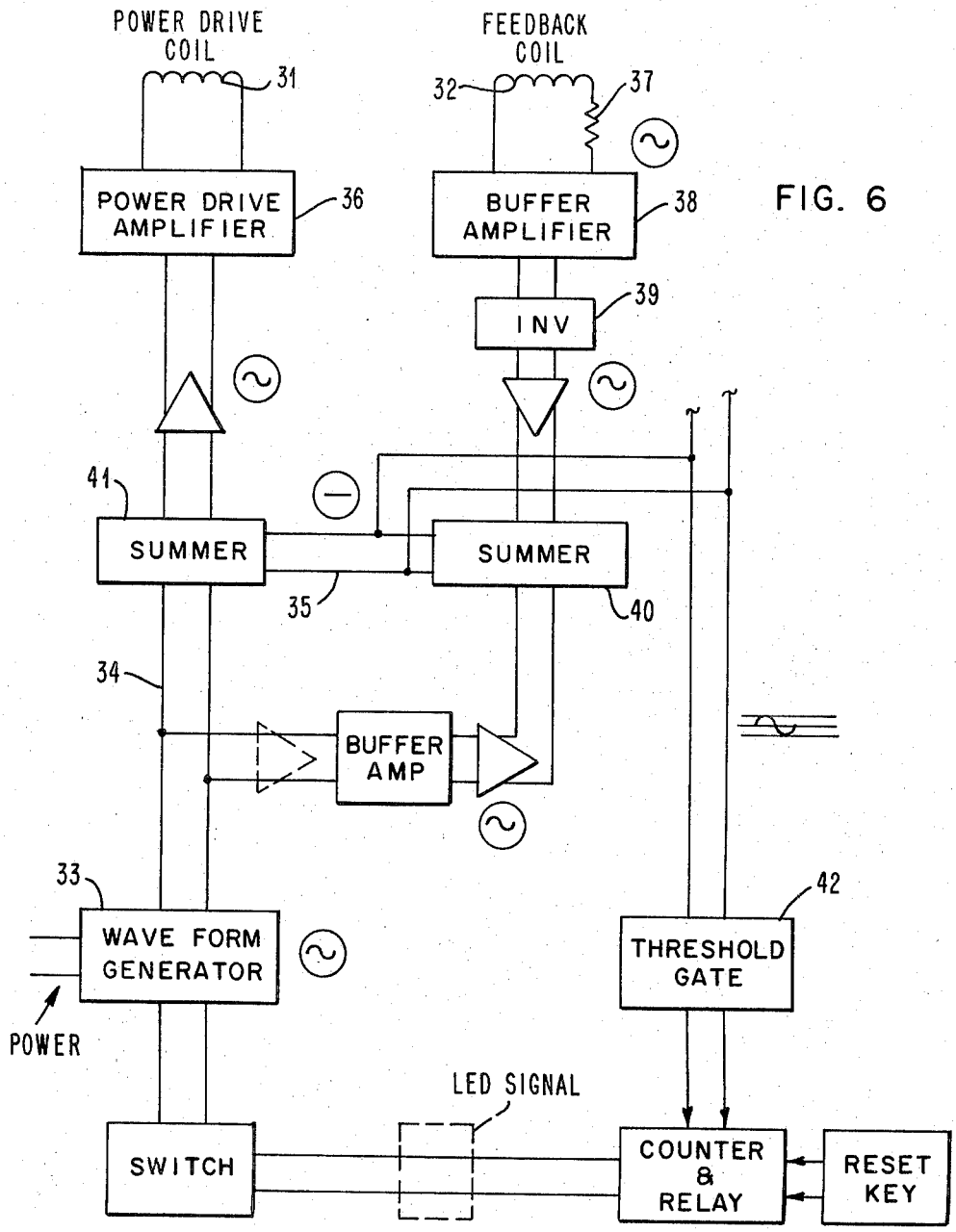
FIG. 6 illustrates an electrical flow chart and schematic diagram for the control and feedback of the voice coil linear driver mechanism shown in FIG. 2.

The linear voice coil driving assembly 14, 15 and 16 indicated in FIG. 2 can be driven electronically using power drive amplifiers similar to those employed in the audio or high fidelity industry. The specific drive coils are mounted in the armature 15 and are supplied with current by the circuit shown schematically in FIG. 6. An additional winding is supplied in the armature 16 to provide a back EMF pick up signal providing feedback for the control of the precise velocity and position of the armature 16. The circuitry of FIG. 6 schematically shows the overall drive and feedback control technique.

Separate windings 31 and 32 are schematically illustrated and will be described further with respect to specific figures depicting them. A waveform generator 33 generates a rising voltage waveform of the proper shape and duration (to be described below) at its output 34. This is summed with the feedback coming on line 35 which provides a small correction to the output signals which are then applied to a lower driving amplifiler 36 for eventually driving coil 31. As current is applied to coil 31 by the amplifier 36, the fixed pole piece 14 (not shown in FIG. 6) interacts with the electromagnetically generated field of the coil 31 to cause the coil to move inward or outward along the pole piece in element 14 in a manner similar to which a voice coil drives an ordinary audio speaker element.

Feedback signals are generated by an EMF generated in coil 32 through a load resistor 37. These signals are sensed at an input buffer amplifier and inverted in inverter 39 where they may be at the output compared or summed with the output from the waveform generator in the summer 40. These provide, if any difference or excess exists, a feedback control on line 35 to the summer 41 for modifying the input of power drive amplifier 36 to more accurately control the velocity and position of the moving coil 31. Overall limits on the voltage excursions can be compared in threshold gate 42 and employed to drive an indicator which will be described in further detail below.

The circuit of FIG. 6 may be further described as follows. The feedback coil 32 is physically attached to the mounting core of the power drive coil 31 so that the two coils move together in the presence of the same magnetic field. As the power coil 31 moves, an electro motive force (EMF) will be generated in the feedback coil 32. Under normal operation, this feedback should be identical in amplitude waveform and frequency to that of the drive coil signal coming from the power drive amplifier 36. Should any aberration of motion occur during the operation of the printer such as by means of a paper jam or intrusion of a foreign object, the signal produced by the feedback coil will be different from that provided to the power amplifier 36. The circuit in FIG. 6 processes the feedback signal to detect or correct for these conditions.

The feedback signal is sent to an inverting amplifier 39 through a buffer amplifier 38 to avoid any distortion interaction from the feedback coil 32 modifying the operation of the drive coil 31. From the inverting amplifier 39 the signal is summed with the original driving signal in the summer 40 to yield a correction signal. In normal operation the correction signal will be very small and will be centered about 0. The small signals are fed back into the drive amplifier 36 through summer 41. The resulting motion of the drive coil 31 will be one that better tracks the input waveform. If there is a malfunction such that the motion of the drive coil 31 is impeded and differs significantly from the original driving signal, this will be detected by a threshold gate 42 detecting a level of feedback beyond set limits which may be chosen as desired. This event can be used to shut off power and illuminate a light or LED to notify the user that an irregular operating condition has occured. A reset button or switch can be installed if desired to reset and resume operation.

Details for the drive coil 31 and the feedback coil 32 in the preferred embodiment are as follows.

The drive coil consists of 240 turns in two layers of 120 turns each of close wound enamel insulated #31 gauge magnet wire and exhibits a total resistance of approximately 6.6 ohms. The feedback winding for coil 32 is one layer of 40 turns of #36 gauge enamel insulated magnet wire wound on a 0.76 mm pitch on the outer layer of the inner drive coil but insulated therefrom by a single layer of insulating tape between windings. This latter winding exhibits 3.6 ohm resistance.

The return leg of the winding is brought back inside of the turns of the winding coil to hold it securely in place in the same manner that voice coils are wound on bobbins. The coil is shown schematically in FIG. 7.

Figure 7:
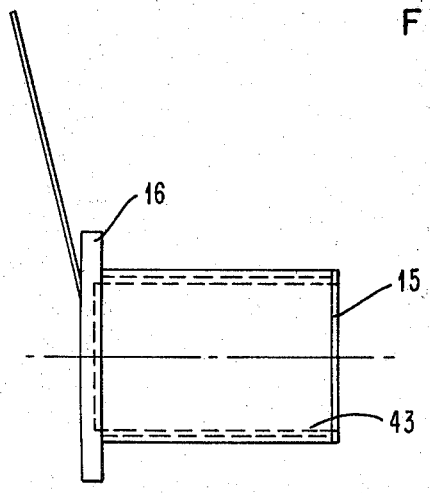
FIG. 7 illustrates the detail of the voice coil winding employed in the preferred embodiment.

In FIG. 7 the moving armature 15 and the driving cross head 16 are attached to a bobbin core 43 which may be of non-magnetic metal, cardboard, plastic or the like. In the preferred embodiment, this bobbin is made of aluminum for strength and is machined to a smooth finish for a close but non-frictional fit into the aperture of the driving pole piece 14.

Figure 8:
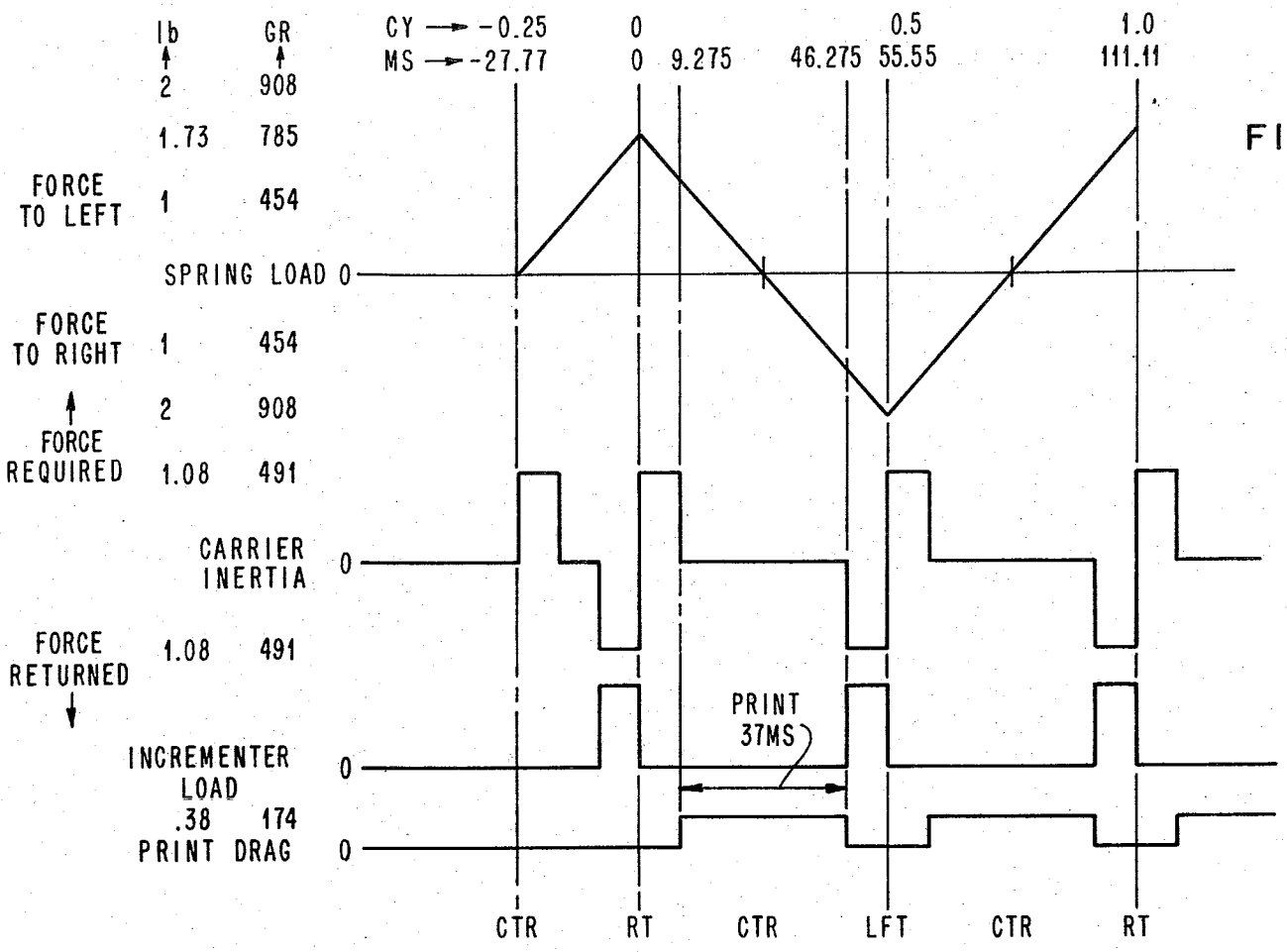
FIG. 8 is a force and displacement chart for operation of the mechanism shown in FIG. 2 over a complete cycle of oscillation from left to right and back.
Figure 9:
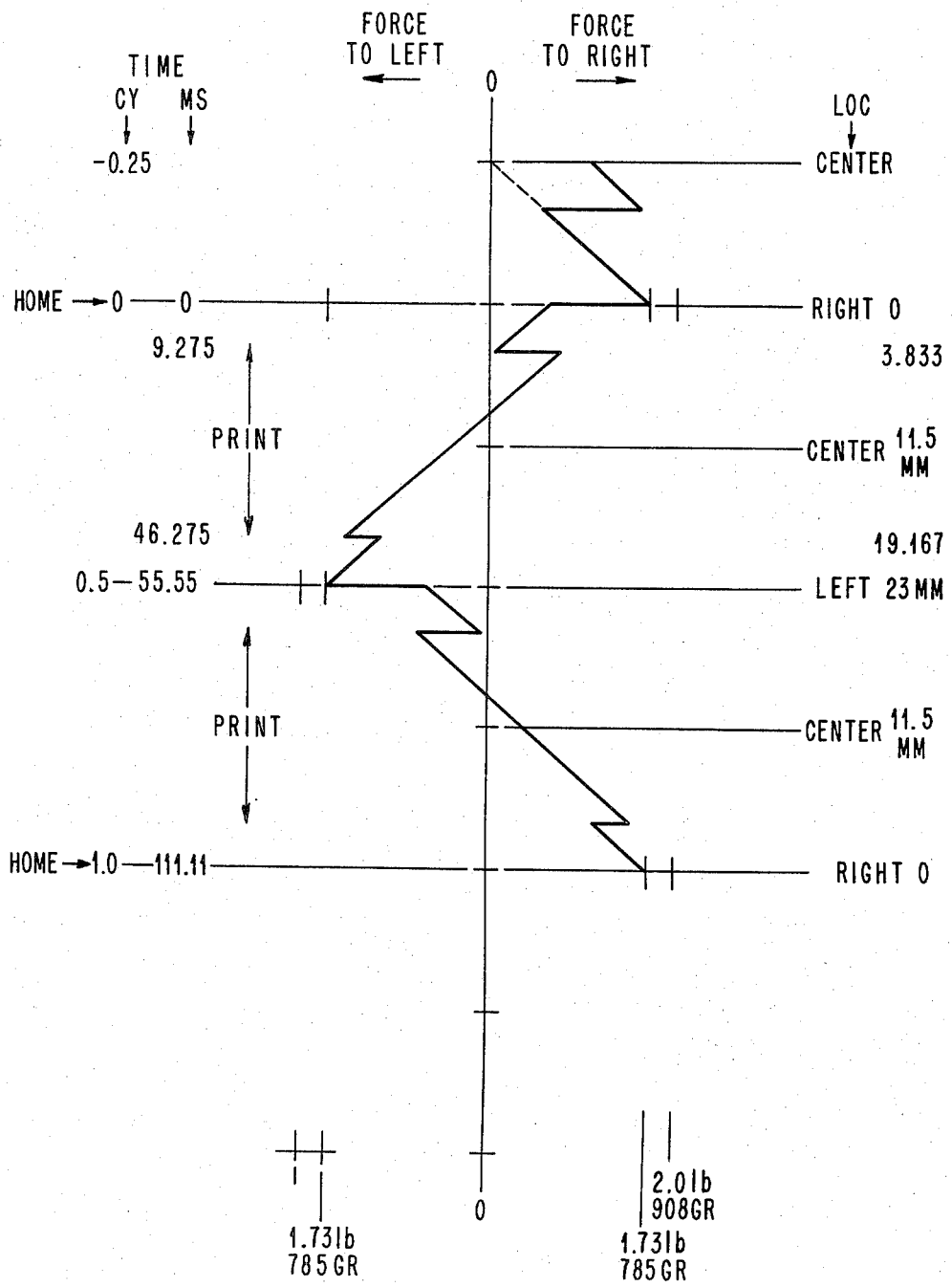
FIG. 9 is a force and displacement chart for the forces to be generated by the voice coil to drive the carrier assembly as shown in FIG. 2.

FIG. 8 illustrates the spring loading forces moving right and left including the forces occasioned by the cam operated paper incrementer mechanism 17 and 18, etc. These forces must be supplied by the driving coil and result in the total force shown in FIG. 9 for one complete cycle from right to left and back to the right again. As may be understood, when the spring carrier suspension mechanism is deflected to the right or left of center, energy stored in the spring is released. Thus, for at least a portion of the return stroke, the coil need not supply as much force. However, after crossing the center or 0 force position, additional energy must be supplied to deflect the spring in the opposite direction. When these forces are operated at or near the natural period of vibration for the spring suspension system, some efficiency in operation results.

If the frequency of oscillation of current reversal applied to the driving coil is adjusted to be at or approximately the same as the natural period of vibration of the spring and carrier mass suspension system, very small additional forces are required in order to keep the system in motion. These are chiefly those forces which are extracted by the paper incrementing mechanism near each end of the travel from left to right or right to left. Frictional losses are minimum since there are no bearings, pivots, slides, etc. Frictional losses due to air motion are the primary source of loss other than the direct mechanical loss due to extraction of force by the paper incrementing mechanism previously described.

Having thus described our invention with reference to a preferred embodiment of operation thereof, it will be obvious to those of skill in the art that numerous specific design factors may be modified without departing from the spirit and scope which comprise the essence thereof. Therefore, the following claims are intended to be viewed in part as described rather than limitation.

Having thus described our invention, what we claim and desire to protect by Letters Patent is:

1. A dot printer comprising:

at least one dot forming printing element;

a unitary molded flexible plastic combined suspension spring and frame element;

said printing element being affixed to said frame element;

a platen, said platen being arranged adjacent to and parallel with said frame element on which said printing element is affixed;

said unitary molded flexible plastic suspension spring and frame element comprising at least two comb like shaped plate springs having first, second and third legs, respectively, the free ends of said first and third legs being integrally molded with said frame element and the second legs thereof being rigidly mounted to a fixed location in said printer to support said comb like shaped plate springs generally orthogonal to an intended print line and parallel with each other;

a purely linear reciprocating drive means for causing linear reciprocation without orthogonal or off axis forces, said drive means being connected to said frame element and arranged with respect thereto for reciprocating the same and flexing said first and third legs of said comb like shaped plate springs while moving said frame element and said dot forming printing element thereon back and forth along a desired print line parallel to said platen;

said comb like shaped plate springs having the base ends of said first, second and third legs commonly molded together in an integral base element for each of said plate springs, said base elements being freely suspensed for motion when said first and third legs thereof are flexed;

paper print media drive means for feeding said paper incrementally past said platen;

incremental cam and clutch means and an interposer means, said interposer means being affixed to said integrally molded frame element and reciprocated therewith and interacting with said cam and one way clutch means for providing intermittant rotary output, said intermittant rotary output being connected to said paper media drive and incrementing means to increment said paper at the end of each said recriprocation.

2. A dot printer comprising:

at least one dot forming printing element;

a unitary molded flexible plastic combined suspension spring and frame element;

said printing element being affixed to said frame element;

a platen, said platen being arranged adjacent to and parallel with said frame element on which said printing element is affixed;

said unitary molded flexible plastic suspension spring and frame element comprising at least two comb like shaped plate springs having first, second and third legs, respectively, the free ends of said first and third legs being integrally molded with said frame element and the second legs thereof being rigidly mounted to a fixed location in said printer to support said comb like shaped plate springs generally orthogonal to an intended print line and parallel with each other;

a purely linear reciprocating drive means for causing linear reciprocation without orthogonal or off axis forces, said drive means being connected to said frame element and arranged with respect thereto for reciprocating the same and flexing said first and third legs of said comb like shaped plate springs while moving said frame element and said dot forming printing element thereon back and forth along a desired print line parallel to said platen;

said comb like shaped plate springs having the base ends of said first, second and third legs commonly molded together in an integral base element for each of said plate spring, said base elements being freely suspended for motion when said first and third legs thereof are flexed;

said comb like shaped plate springs having said commonly attached integrally molded base elements thereof adapted to cause a fanning action of air whenever said legs are flexed by the reciprocation of said frame.

3. Apparatus as described in claim 1 or 2 wherein:

the combined spring rates of said first and third legs of each of said plate spring elements equals that of the second said leg for each said plate spring.

4. Apparatus as described in claim 1 or 2, wherein: said unitary molded flexible suspension spring and frame element is molded integrally of a plastic having a specific gravity of at least 1.06, a tensile modulus of at least $3.4\times10^5$ PSI and a creep modulus of at least 320 KPSI at 73° F. and 1.5 KPSI load.

* * * * *